US009902039B2

(12) United States Patent
Vogel et al.

(10) Patent No.: US 9,902,039 B2
(45) Date of Patent: Feb. 27, 2018

(54) SYSTEMS AND METHODS FOR CONDITIONING BLADES

(71) Applicant: Wolff Industries, Inc., Spartanburg, SC (US)

(72) Inventors: David Vogel, Columbus, IN (US); Walker Newell, Elizabethtown, IN (US)

(73) Assignee: Wolff Industries, Inc., Spartanburg, SC (US)

( * ) Notice: Subject to any disclaimer, the term of this patent is extended or adjusted under 35 U.S.C. 154(b) by 0 days.

(21) Appl. No.: 15/272,759

(22) Filed: Sep. 22, 2016

(65) Prior Publication Data

US 2017/0087690 A1 Mar. 30, 2017

Related U.S. Application Data

(60) Provisional application No. 62/222,864, filed on Sep. 24, 2015.

(51) Int. Cl.

| | |
|---|---|
| ***B24B 51/00*** | (2006.01) |
| ***B24B 3/54*** | (2006.01) |
| ***B24B 3/52*** | (2006.01) |
| ***B24B 49/12*** | (2006.01) |
| ***B24B 19/00*** | (2006.01) |

(52) U.S. Cl.

CPC ..... *B24B 51/00* (2013.01); *B24B 3/52* (2013.01); *B24B 3/54* (2013.01); *B24B 19/002* (2013.01); *B24B 49/12* (2013.01)

(58) Field of Classification Search

CPC .. B24B 51/00; B24B 3/52; B24B 3/54; B24B 19/002; B24B 49/12

USPC ..... 451/5

See application file for complete search history.

(56) References Cited

U.S. PATENT DOCUMENTS 1,811,069 A * 6/1931 Webb ..... B24B 3/52 451/282
4,176,396 A * 11/1979 Howatt ..... G01N 3/58 700/175
5,157,870 A * 10/1992 Pike ..... B24B 3/52 269/262

(Continued)

FOREIGN PATENT DOCUMENTS

JP H0639690 A 2/1994
JP H1015803 A 1/1998

(Continued)

OTHER PUBLICATIONS

Wolff Industries, Inc.; International Patent Application No. PCT/US2016/052993; International Search Report and Written Opinion; dated Dec. 20, 2016.

(Continued)

*Primary Examiner* — George Nguyen
(74) *Attorney, Agent, or Firm* — Dority & Manning, P.A.

(57) ABSTRACT

Systems and methods for conditioning blades are provided. A method may include, for example, obtaining a cutting device, measuring various characteristics of the cutting edge of the cutting device, creating a current edge profile based on the characteristics, creating a modified edge profile, and/or conditioning the blade. Conditioning may include grinding, buffing and/or polishing. One or more of the conditioning steps may be based on the modified edge profile.

18 Claims, 10 Drawing Sheets

(56) References Cited

U.S. PATENT DOCUMENTS

| | | | | |
|---|---|---|---|---|
| 5,291,690 | A * | 3/1994 | Pike | B24B 3/52 269/262 |
| 5,793,493 | A * | 8/1998 | Lane | G01B 11/24 356/613 |
| 8,758,084 | B2 | 6/2014 | Knecht et al. | |
| 8,915,766 | B1 | 12/2014 | Kolchin | |
| 2002/0009963 | A1 * | 1/2002 | Clauss | A01F 29/22 451/419 |
| 2002/0025757 | A1 | 2/2002 | Gross | |
| 2007/0197148 | A1 * | 8/2007 | Friel | B24B 3/54 451/349 |
| 2010/0112899 | A1 * | 5/2010 | Hofer | B24B 19/14 451/5 |
| 2011/0281503 | A1 * | 11/2011 | Knecht | B24B 3/54 451/5 |

FOREIGN PATENT DOCUMENTS

| | | | | |
|---|---|---|---|---|
| WO | WO 2009082508 | A1 * | 7/2009 | B24B 3/52 |
| WO | WO2012/091670 | A1 | 7/2012 | |

OTHER PUBLICATIONS

Wolff Industries, Inc.; International Patent Application No. PCT/US2015/052993; International Search Report; dated Dec. 20, 2016; (2 pages).

* cited by examiner

SYSTEMS AND METHODS FOR CONDITIONING BLADES

PRIORITY STATEMENT

The present application claims priority to U.S. Provisional Patent Application Ser. No. 62/222,864, filed Sep. 24, 2015 and which is incorporated by reference herein in its entirety.

FIELD OF THE INVENTION

The present disclosure relates generally to systems and methods for conditioning blades.

BACKGROUND OF THE INVENTION

Knives, scissors and other cutting tools are utilized on an everyday basis in a wide variety of situations, ranging from food preparation to various outdoor uses, such as chopping wood, to self-defense. In order to facilitate efficient and effective cutting by the blades of such cutting tools, and to facilitate the safety of users of the blades, the blades should be maintained with sharp, straight cutting edges. Any cutting processes result in the cutting edges of the blades quickly becoming dull and including defects, such as nicks, which necessitates periodic conditioning of the blades.

Many tools are available for conditioning blades. For example, many typically known hand-held conditioning devices utilize stationary rods which are positioned to form a blade conditioning zone therebetween at an intersection of the rods. The blade is dragged through the blade conditioning zone and contacts the rods, and this contact between the blade and the rods conditions the blade. However, such stationary rods in many cases do not adequately condition blades, and may not be suitably adaptable to a variety of blades having different sizes and shapes.

Known automated processes for conditioning blades also have various disadvantages. For example, U.S. Pat. No. 8,758,084 to Knecht et al., issued on Jun. 24, 2014 and which is incorporated by reference herein in its entirety, is directed to apparatus for grinding hand knives. U.S. Pat. No. 8,915,766 to Kolchin, issued on Dec. 23, 2014 and which is incorporated by reference herein in its entirety, is directed to automatic knife sharpeners and methods for their use. However, neither Knecht et al. nor Kolchin measures the entire edge profile of a blade to be conditioned and conditions the blade to a modified edge profile that approximates characteristics of the original edge profile, such as the curvature, etc.

Accordingly, improved systems and methods for conditioning blades are desired. In particular, automated systems and methods which measure the entire edge profile of a blade to be conditioned and condition the blade to a modified edge profile that approximates characteristics of the original edge profile would be advantageous.

BRIEF DESCRIPTION OF THE INVENTION

Aspects and advantages of the invention will be set forth in part in the following description, or may be obvious from the description, or may be learned through practice of the invention.

Systems and methods for conditioning a blade are disclosed. In exemplary embodiments, such systems and methods advantageously measure the entire edge profile of a blade to be conditioned and condition the blade to a modified edge profile that approximates characteristics of the original edge profile. The overall quality and appearance of the resulting blade and cutting edge thereof may thus be increased relative to various known blade conditioning systems and methods.

A system in accordance with the present disclosure may include, for example, a gripper assembly that grips a cutting device and moves the cutting device within the system. In particular, the gripper assembly may orient the cutting device as required for measurement of the cutting edge thereof, and may then move the cutting device such that the cutting edge contacts a grinding assembly in accordance with a modified edge profile created based on the measurements of the cutting edge. The gripper assembly may further move the cutting device such that the cutting edge contacts a buffing assembly and a polishing assembly, in some embodiments in accordance with the modified edge profile. The blade may be conditioned by grinding and, optionally, buffing and/or polishing of the cutting edge.

The system may further include a first measurement device which measures various characteristics of the blade, including for example the thickness of the blade along a width thereof. The system may further include a second measurement device which measures various characteristics of the blade, including for example, the width of the blade along a length thereof. These measurements may be utilized to create a current edge profile. A modified edge profile may then be created, based on the current edge profile.

The system may further include a grinding assembly and, optionally, a buffing assembly and/or polishing assembly. The blade may contact these assemblies for respective grinding, buffing and/or polishing purposes.

The system may further include a processor, which may be in communication with the various other components of the system as discussed herein. The processor may cause movement of the gripper assembly to initially pick up a cutting device for conditioning, and to provide the cutting device for measurement thereof. The processor may further, for example, create the current edge profile based on the measurements, and then create the modified edge profile based on the current edge profile. The processor may further cause movement of the gripper assembly, and thus the blade, in accordance with the modified edge profile and other suitable data points, directions, etc., to interact with the grinding assembly, buffing assembly and/or polishing assembly.

In one embodiment, a system for conditioning blades is provided. The system defines an orthogonal coordinate system comprising an X-axis, a Y-axis and a Z-axis. The system includes a gripper assembly for gripping a cutting device comprising a blade, the gripper assembly movable along and about the X-axis, the Y-axis and the Z-axis. The system further includes a first measuring device operable to measure a width and a thickness of the blade, wherein the gripper assembly orients the blade for measurement by the first measuring device. The system further includes a second measuring device operable to measure the width and a length of the blade, wherein the gripper assembly orients the blade for measurement by the second measuring device. The system further includes a processor, the processor configured for creating a current edge profile based on the width, thickness and length measurements, and adjusting the current edge profile to a modified edge profile.

A method in accordance with the present disclosure may include, for example, obtaining a cutting device, measuring various characteristics of the cutting edge of the cutting device, creating a current edge profile based on the characteristics, creating a modified edge profile, and/or conditioning the blade. Conditioning may include grinding, buffing and/or polishing. One or more of the conditioning steps may be based on the modified edge profile.

In one embodiment, a method for conditioning blades is provided. The method includes measuring a width, thickness and length of the blade. The method further includes creating, using a processor, a current edge profile for the entire blade based on the width, thickness and length measurements. The current edge profile includes X-axis, Y-axis and Z-axis data points for the blade. The method further includes adjusting, using a processor, the current edge profile to a modified edge profile. The method further includes conditioning the blade based on the modified edge profile.

Notably, in exemplary embodiments, systems and methods in accordance with the present disclosure may by automated. Further, conditioning may advantageously occur to the entire cutting edge of a blade being conditioned as discussed herein.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
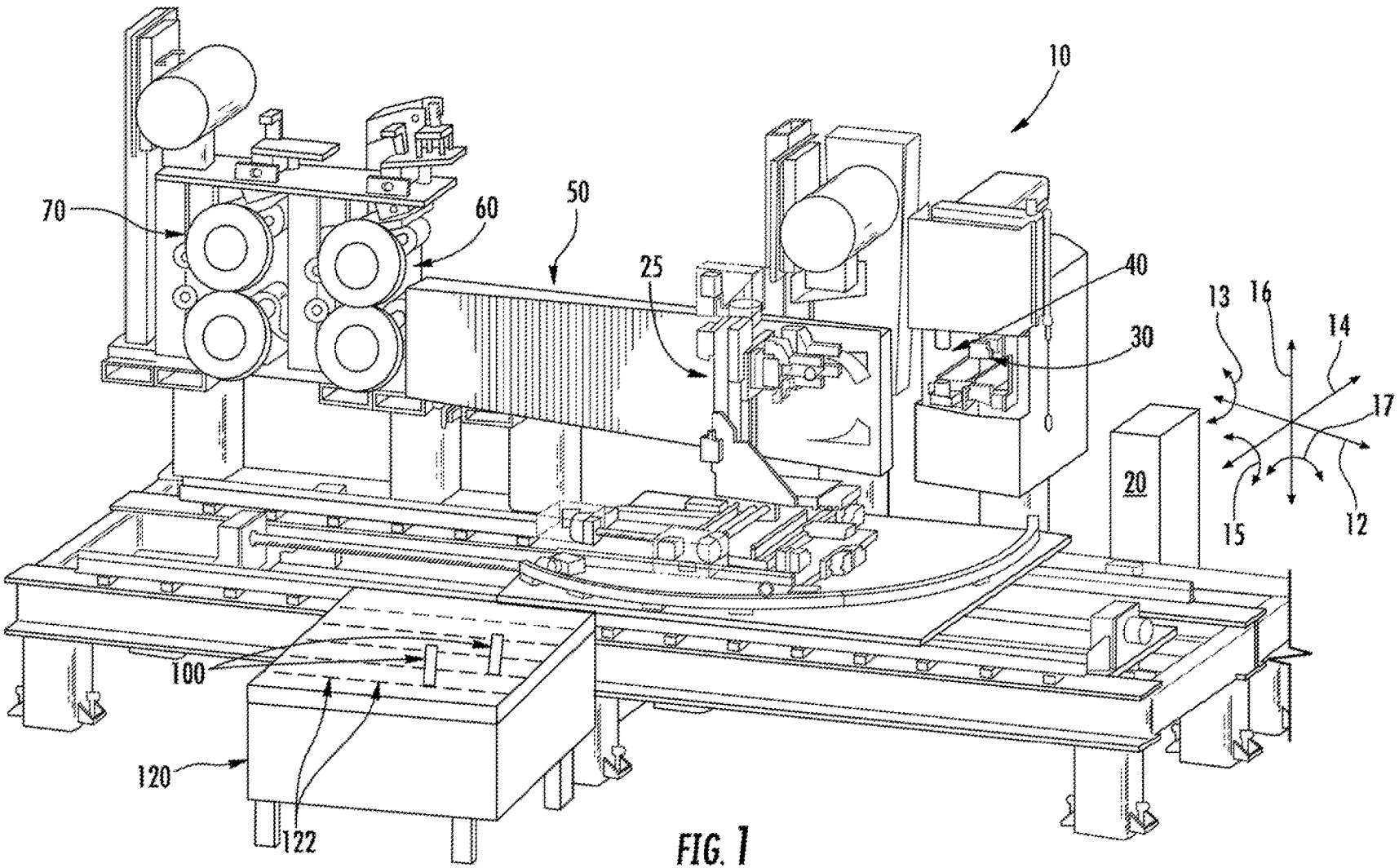
FIG. 1 is a perspective view of a system for conditioning a blade in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to FIG. 1, one embodiment of a system 10 for conditioning blades in accordance with the present disclosure is provided. Systems 10 in accordance with the present disclosure advantageously facilitate efficient and accurate blade conditioning which results in conditioned blades that have edge profiles which approximate the original edge profiles of the blades. Such advantages result, for example, from accurate and efficient measurement of the current blade profile, and conditioning based on such profile. Such advantages further result, for example, from conditioning of the entire edge of the blade based on the current blade profile to obtain a conditioned blade profile which approximates the original edge profile of the blade while advantageously removing defects, such as nicks, from the edge and thinning the blade if necessary.

A coordinate system may generally be defined for the system 10. The coordinate system may include an X-axis 12, a Y-axis 14 and a Z-axis 16, each of which may be mutually orthogonal to the others. Roll, pitch and yaw directions 13, 15, 17 are additionally defined about the X-axis 12, Y-axis 14 and Z-axis 16, respectively.

Figure 3:
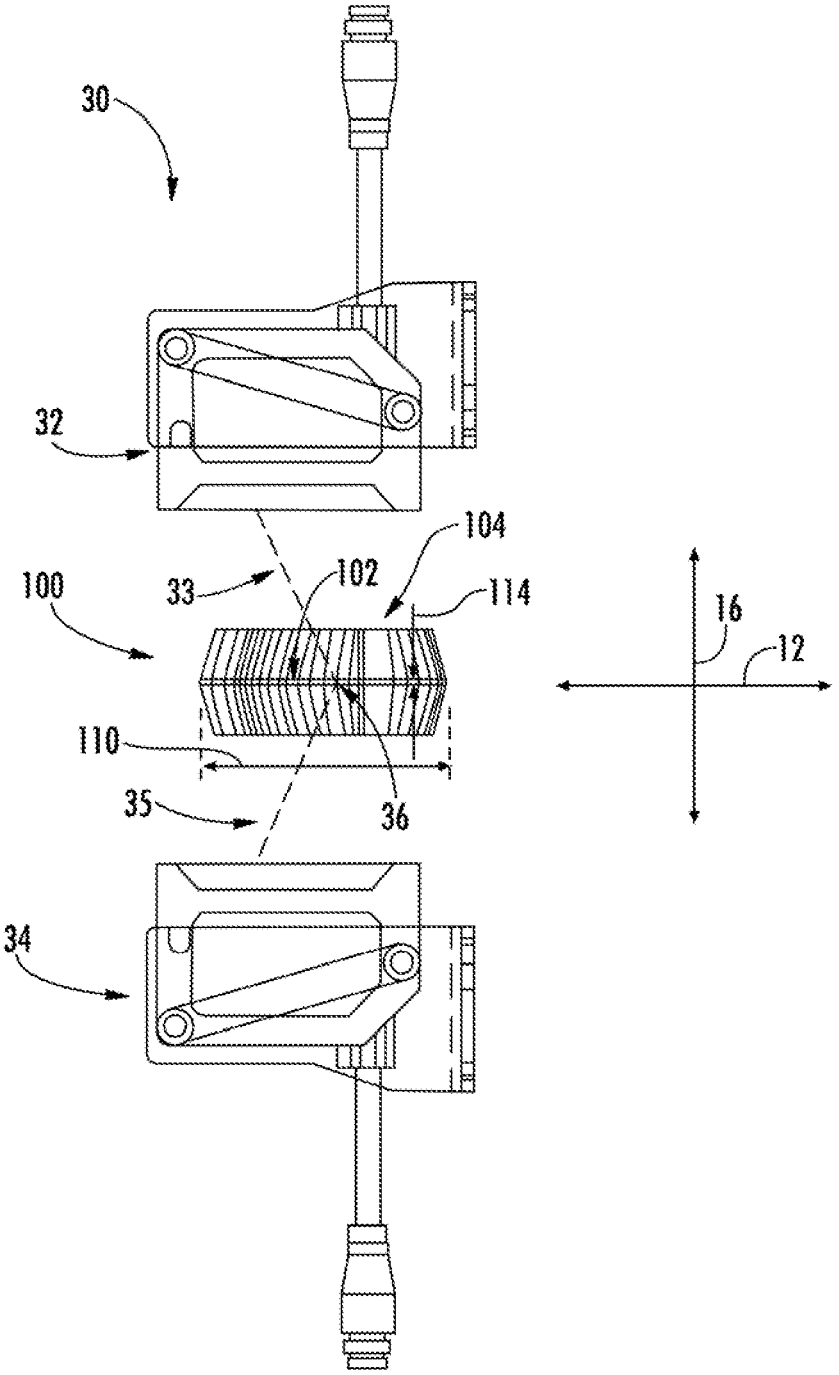
FIG. 3 is a side view of components of a first measuring device during measurement of a blade in accordance with one embodiment of the present disclosure.
Figure 5:
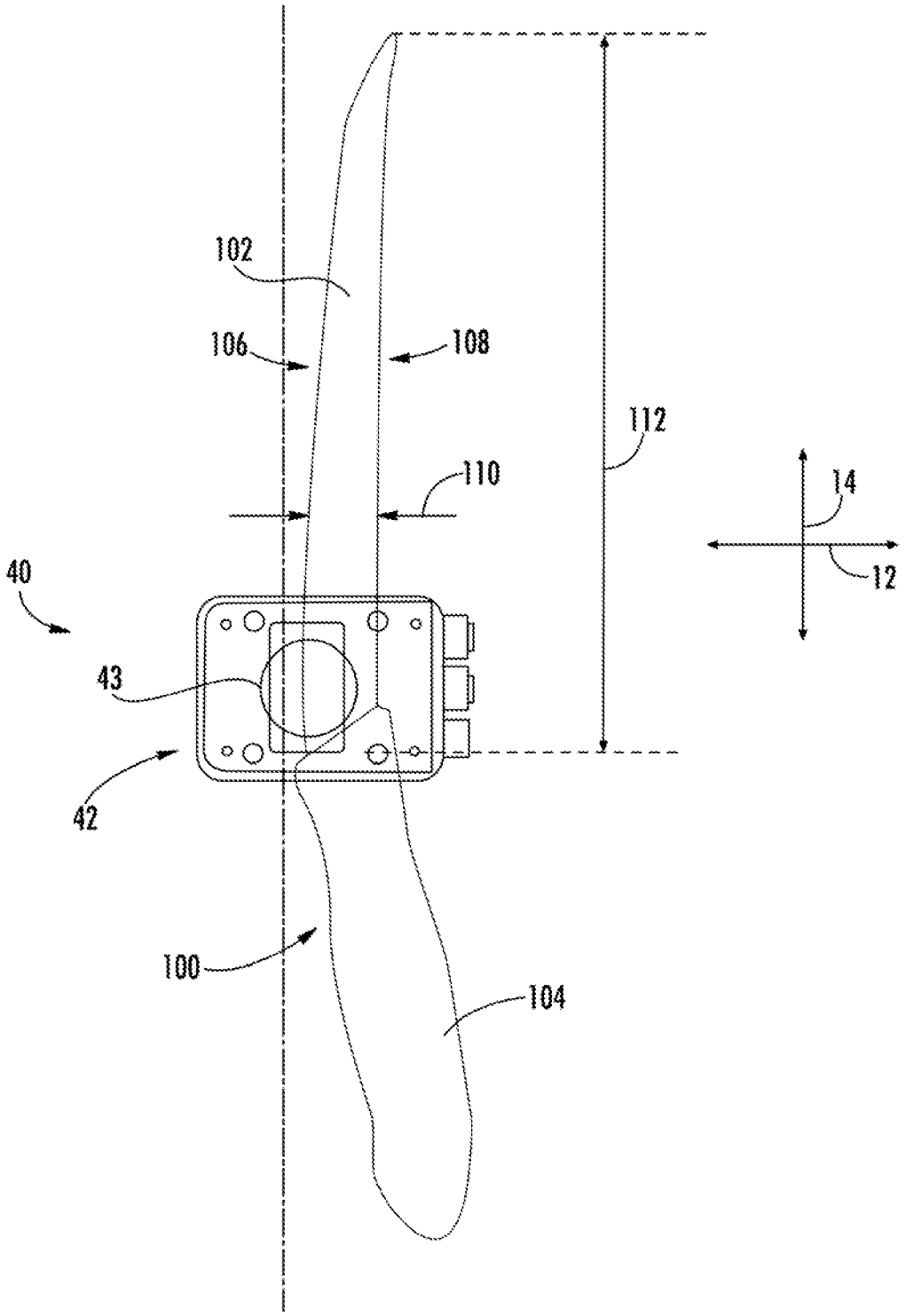
FIG. 5 is a top view of components of a second measuring device during measurement of a blade in accordance with one embodiment of the present disclosure.

Referring briefly to FIGS. 3 and 5, a blade 102 in accordance with one embodiment of the present disclosure is illustrated. The blade 102 in this embodiment is a component of a cutting device 100 (in this embodiment a knife) which includes the blade 102 and a handle 104. The blade 102 generally extends from the handle 104. Alternatively, the blade 102 may be a component of any other suitable cutting device 100, such as scissors, a razor, chisel, axe, hatchet, or any cutting apparatus known in the art. In further alternative embodiments, cutting device 100 may include only the blade 102 itself, with no additional components such as handles, etc. Further, it should be understood that a blade 102 of the present disclosure may be a straight-edged blade, serrated-edge blade, or a blade with any other edge design known in the art. A conditioning system 10 of the present disclosure may interact with the blade 102 to condition the blade, such as, for example, by straightening and/or sharpening the blade.

The blade 102 may have a width 110, a length 112, and a thickness 114, as illustrated and as generally understood. One or more cutting edges 106 may be defined about the perimeter of the blade 102. For example, a blade 102 may be a single edge blade, and thus include one cutting edge 106 and an opposite spine 108, as illustrated, or may include two opposite cutting edges 106. The thickness 114 of the blade 102 may generally taper along a portion of the width 110 towards the perimeter of the blade 102 to define a cutting edge 106. It should be noted that a cutting edge 106 as utilized in accordance with the present disclosure refers to a portion of the perimeter of the blade 102 which is considered generally capable of performing a cutting task, as is generally understood. Accordingly, other portions of the perimeter which, for example, are not tapered are not considered to be portions of a cutting edge 106 as utilized herein.

Referring again to FIG. 1, system 10 may include a processor 20. In general, as used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Processor 20 may also include various input/output channels for receiving inputs from and sending control signals to various other components with which the processor is in communication, such as other components of the system 10 as discussed herein. Processor 20 may generally perform various steps as discussed herein. Further, it should be understood that a processor 20 in accordance with the present disclosure may be a single master processor 20 in communication with the other various components of system 10, and/or may include a plurality of individual component processors.

It should additionally be noted that the processor 20 or components thereof may be onboard the system 10 hardware or may be off-board, such as at a remote location. For example, in some embodiments, processor 20 or components thereof may be embodied as a remote central server that receives information from numerous in-field systems. Processor 20 or components thereof may thus be in communication with the other various components of system 10 via suitable wired and/or wireless communication.

System 10 may further include, for example, a gripper assembly 25 which may be configured to grip a cutting device 100. The gripper assembly 25 may include one or more clamp arms 27, as illustrated, which may contact and grip the cutting device 100 for movement and manipulation as discussed herein. For example, as illustrated the clamp arms 27 may grip a handle 104 of the cutting device 100, advantageously leaving the blade 102 exposed for conditioning. Jaws 29 of each clamp arm 27 may move towards each other to contact and grip a cutting device 100, and may move away from each other to release the cutting device 100.

The clamp arms 27 may be movable along and/or about one or more axes. For example, in exemplary embodiments, the clamp arms 27 may be movable along the X-axis 12, Y-axis 14 and/or Z-axis 16, and may further be rotatable in the roll direction 13, pitch direction 15 and yaw direction 17. Such movement of the clamp arms 27 may generally facilitate movement of the blade 102 as required for conditioning, as discussed herein.

One or more cutting devices 100 may be provided for conditioning in system 10 in a blade magazine 120. The magazine 120 may include a plurality of slots 122 for accommodating the blades 102 of a plurality of cutting devices 100 which are provided for conditioning. The clamp arms 27 may remove a cutting device 100 from a blade magazine 120, such as from a slot 122 therein. The blade 102 of the cutting device 100 may be conditioned in system 100. The clamp arms 27 may then replace the cutting device 100 in either the same blade magazine 120 or a different blade magazine 120 (and slot 122 thereof) when conditioning is finished.

Figure 2:
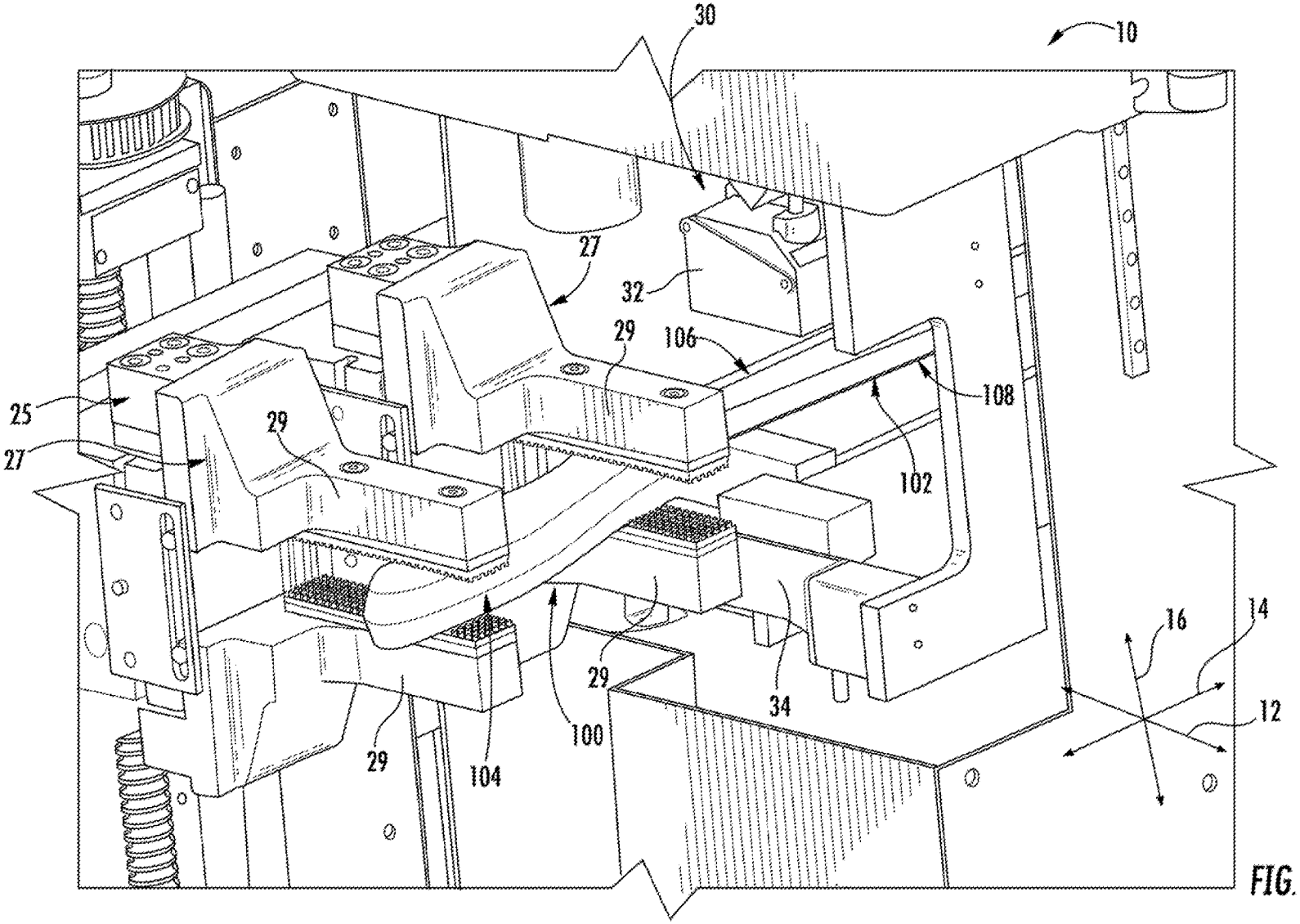
FIG. 2 is a perspective view of a gripper assembly providing a cutting device for measurement by a first measuring device in accordance with one embodiment of the present disclosure.

Referring now to FIGS. 2 and 3, system 10 may further include a first measuring device 30. The first measuring device 30 may generally be configured to measure a width 110 and thickness 114 of the blade 102, and to output data points corresponding to the thickness 114 along the width 110 at one or more locations along the length 112 of the blade 102.

For example, device 30 may include a first laser 32 and a second laser 34 which may each be configured to emit laser light beams 33, 35. The lasers 32, 34 may, for example, be spaced apart from each other along the Z-axis 16 and may face each other. Light beams 33, 35 may be emitted along or at an angle to the Z-axis 16 generally towards each other, and may intersect at a focal point 36 between the lasers 32, 34 when there are no obstructions between the lasers 32, 34. The blade 102 may be moved (by the gripper assembly 25) into a position such that the width 110 of the blade 102 is approximately within an X-axis 12/Y-axis 14 plane and aligned along the X-axis 12. Accordingly, the width 110 may extend along the X-axis 12, the length 112 may extend along the Y-axis 14, and the thickness 114 may extend along the Z-axis 16. The blade 102 may then be moved across the focal point 36, such as in a direction along the X-axis 12. The blade 102 may break the interaction of the laser light beams 33, 35, and such contact by the laser light beams 33, 35 with the blade 102 may cause measurement of the blade 102. For example, the blade 102 may move along the X-axis 12. The width 110 at a location along the length 112 may be measured based on when and where during such movement that beams 33, 35 initially contact the blade 102 and subsequently cease contact with the blade 102. Additionally, the thickness 114 throughout such width 110 can be measured, based on the distance traveled by the beams 33, 35 before they contact the blade 102. In some embodiments, such measurement may be taken only once at a particular location along the Y-axis 14 for the blade 102. Accordingly, no movement of the blade 102 along the Y-axis 14 may be required. Alternatively, multiple measurements may be taken at various locations along the Y-axis 14 (and thus along the length 112 of the blade 102), with movement of the blade 102 along the Y-axis 14 occurring between such movements along the X-axis 12.

Data points for the dimensions measured by the first measuring device 30 may stored, such as in processor 20. The data points may include thickness 114 data points (along the Z-axis 16) and width 110 data points (along the X-axis 12), as well as length 112 data points (along the Y-axis 14). The data points may be utilized in a profile of the blade 102, as discussed herein.

Figure 4:
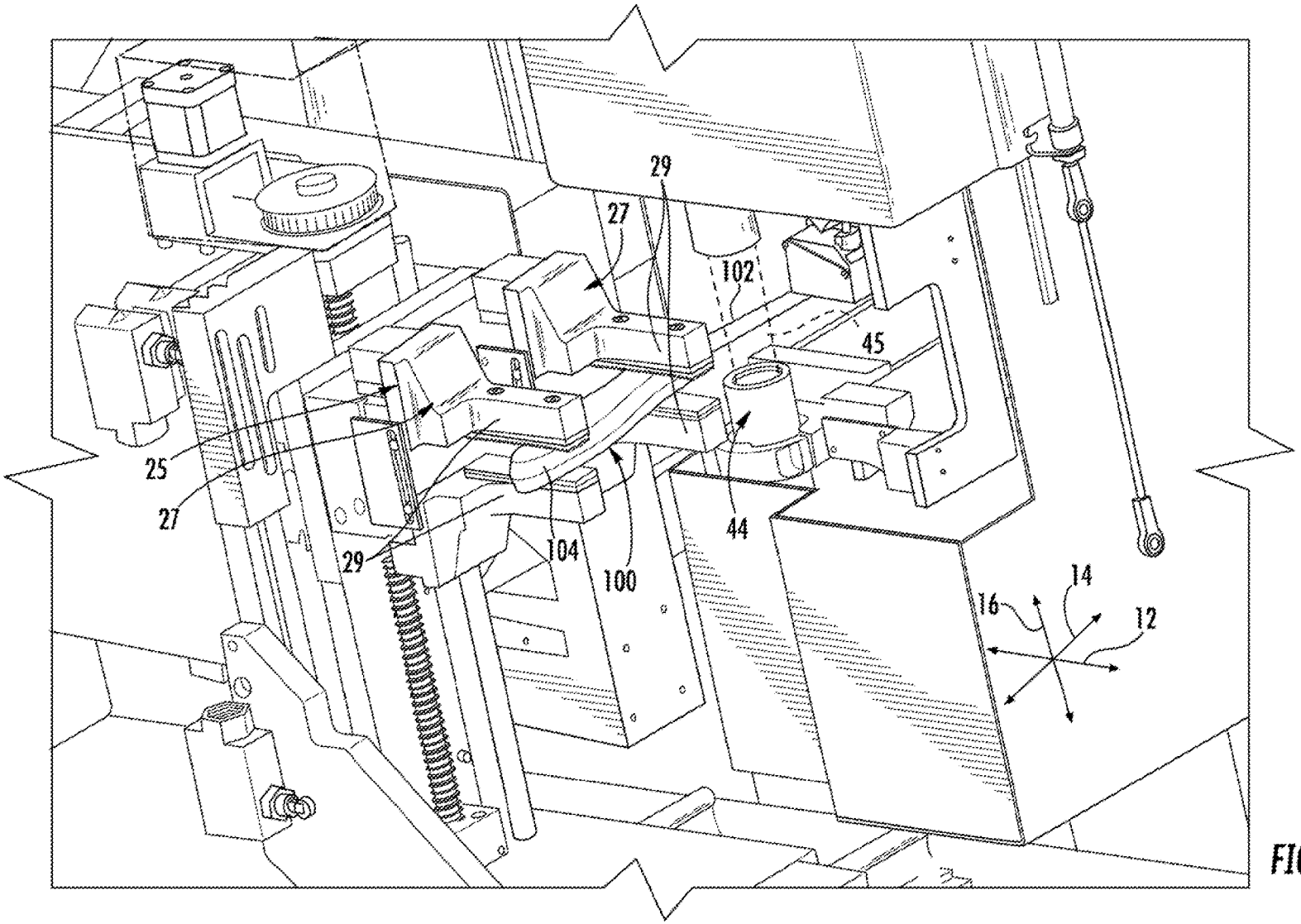
FIG. 4 is a perspective view of a gripper assembly providing a cutting device for measurement by a second measuring device in accordance with one embodiment of the present disclosure.

Referring now to FIGS. 4 and 5, system 10 may further include a second measuring device 40. The second measuring device 40 may generally be configured to measure a width 110 and length 112 of the blade 102, and to output data points corresponding to the width 110 along the length 112 of the blade 102.

Second measuring device 40 may, for example, include an imaging device 42 and a light source 44. The imaging device 42 and light source 44 may, for example, be spaced apart from each other along the Z-axis 16 and may face each other. Light 45 may be emitted along or at an angle to the Z-axis 16 generally towards the imaging device 42. Imaging device 42 may be configured to obtain images, and may be oriented such that the images are in a X-axis 12/Y-axis 14 plane.

Imaging device 42 may include a lens assembly 43 and an image capture device (which may be processor 20 or a component thereof). Lens assembly 43 may generally magnify images viewed by the lens assembly 43 for processing by the image capture device. Lens assembly 43 in some embodiments may, for example, be a suitable camera lens, telescope lens, etc., and may include one or more lens spaced apart to provide the required magnification. The image capture device may generally be in communication with the lens assembly 43 for receiving and processing light from the lens assembly 43 to generate images. In exemplary embodiments, for example, the image capture device may be a camera sensor which receives and processes light from a camera lens to generate images, such as digital images, as is generally understood.

Imaging device 42 may be utilized to obtain images of the blade 102, such as of the width 110 and length 112 thereof. For example, the blade 102 may be moved (by the gripper assembly 25) into a position such that the width 110 of the blade 102 is approximately within an X-axis 12/Y-axis 14 plane and aligned along the X-axis 12. Accordingly, the width 110 may extend along the X-axis 12, the length 112 may extend along the Y-axis 14, and the thickness 114 may extend along the Z-axis 16. The blade 102 may then be moved such that a portion of the blade 102 is within an imaging zone, i.e. is visible to the imaging device 42 (such as through the lens assembly 43 thereof). In exemplary embodiments, and utilizing data points from the first blade measurement using the first measuring device 30, the blade 102 may be positioned such that the cutting edge 106 at a length-wise location measured during the first blade measurement is centered within the imaging zone along the X-axis 12 and, optionally, the Y-axis 14. The light source 44 may be activated, such that light 45 emitted towards the imaging device 42. The light 45 may backlight the blade 102, and provide contrast between the blade 102 (and cutting edge 106 thereof) and the background in the imaging zone. The imaging device 42 may then obtain an image of the portion of the blade 102 within the imaging zone.

Once an image is obtained, the blade 102 may be moved, such as along the Y-axis 14, such that another portion of the blade 102 is within the imaging zone. In exemplary embodiments, the cutting edge 106 at a length-wise location may be centered within the imaging zone along the X-axis 12 and, optionally, the Y-axis 14. The light source 44 may be activated (or may remain activated), and a subsequent image of the portion of the blade 102 may be obtained. The blade 102 may be further moved, such as along the Y-axis 14, and images obtained in a similar manner until the entire cutting edge of the blade 102 (and in some embodiments the entire blade 102) has been imaged.

Data points, such as X-axis 12 and Y-axis data points, may be obtained based on the images. In particular, X-axis 12 and Y-axis data points may be obtained for the cutting edge 106. These data points may be based on analysis of the pixels of the images, and in particular on the transition between different color or gray-scale ranges in the pixels which denote a transition from background to blade 102 surface.

The data points generated during the first and second measurements (such as by the first measuring device 30 and the second measuring device 40) may be utilized to create a current edge profile for the blade 102. The current edge profile may include X-axis 12 data points, Y-axis 14 data points, and yaw angle 17 data points which locate the blade 102, and cutting edge 106 thereof, in space. The current edge profile may further include, for example, Z-axis 16 data points, roll angle 13 data points, and/or pitch angle 15 data points. These data points may be generated based on the data points measured during the first and second measurements (such as by the first measuring device 30 and the second measuring device 40).

It should be noted that the first and second measurements may occur a single time or multiple times for evaluation of a blade. In exemplary embodiments, alternating first and second measurements may be performed. For example, in some embodiments, an additional first measurement may occur after the second measurement. An additional second measurement may, in some embodiments, occur after the additional first measurement.

As discussed, the first and second measurements may in exemplary embodiments occur for the entire blade 102. Further, such measurements may be performed at a relatively fast rate. For example, data points during the first and/or second measurement may be generated in some embodiments at a rate of greater than or equal to 1 data point per 0.0001 seconds, such as greater than or equal to 1 data point per 0.00009 seconds, such as one data point per 0.000085 seconds. In some embodiments, greater than or equal to 16,000 data points can be collected along an axis in less than or equal to 2 seconds for a six-inch long blade.

As discussed, the cutting edge 106 may include various defects, such as nicks, etc. Further, the thickness 114 of the blade 102 at or adjacent to the cutting edge 106, in some cases, may be greater than desired. Such defects and increased thickness may be caused by use of the blade 102, and are considered undesirable. To facilitate removal of edge defects, the current edge profile obtained as discussed herein may be modified to obtain a modified edge profile. For example, data points, such as X-axis data points, wherein defects are present may be deleted from the current edge profile. Defects may be detected as significant differences between a subject data point and the neighboring data points. For example, a difference between a subject data point and one or both neighboring data points may be compared to a predetermined threshold difference. When the difference is above such threshold, the subject data point may be considered correspond to a defect. Substitute data points, such as substitute X-axis data points, may be added to the profile to replace the original data points. These data points may be obtained by, for example, calculating suitable substitute data points based on neighboring data points (above and below the subject data point along the Y-axis and at Y-axis locations wherein there are no detected defects). For example, if only one substitute data point is needed, the neighboring data points may be averaged to obtain the substitute data point. If more than one data point is needed, the substitute data points may be calculated linearly between the neighboring data points.

Once substitute data points have been provided at all defect locations (such at all necessary X-axis data points), the X-axis data points for the profile may collectively be adjusted by a predetermined amount. In exemplary embodiments, a predetermined amount (corresponding to a desired amount of material to be removed during grinding of the blade 102) may be subtracted from each X-axis data point. The predetermined amount may be the same for each X-axis data point. Notably, in some embodiments, the predetermined amount may be based on the defects, such as the X-axis data points for the defects. For example, the predetermined amount may be equal to or greater than the size of the largest defect (in the X-axis direction). The resulting data set, including the adjusted X-axis data points, may form a modified edge profile which may be utilized for conditioning purposes. In some embodiments, the X-axis data points may additionally be smoothed either before or after such adjustment. Suitable non-parametric regression methods may, for example, be utilized to perform such smoothing.

To facilitate thinning of the blade, the thickness 114 of the blade 102 along the width 110 may be compared to a predetermined maximum thickness. If the thickness 114 is above the predetermined maximum, it may be determined that thinning is required.

Notably, the various analyses performed herein, such as by processor 20, may be performed on a significantly large number of data points. Additionally, a significantly large number of calculations may be performed. Analysis of such magnitude advantageously provides improved resulting blade quality. In some embodiments, for example, greater than or equal to 16,000 data points may be collected and greater than 1.8 billion calculations performed for each axis for a 6-inch blade.

Figure 6:
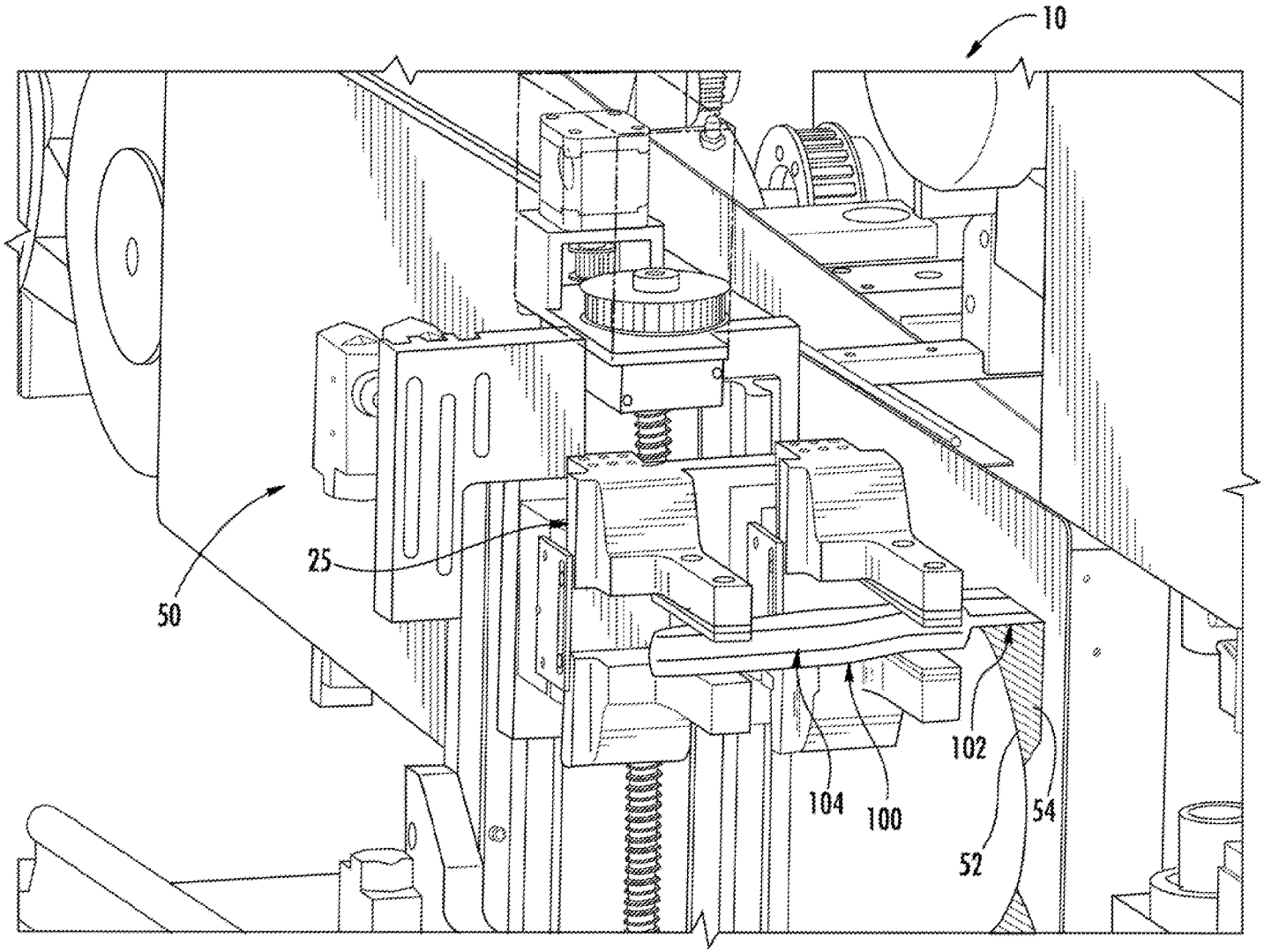
FIG. 6 is a perspective view of a gripper assembly providing a cutting device for grinding by a grinding assembly in accordance with one embodiment of the present disclosure.
Figure 7:
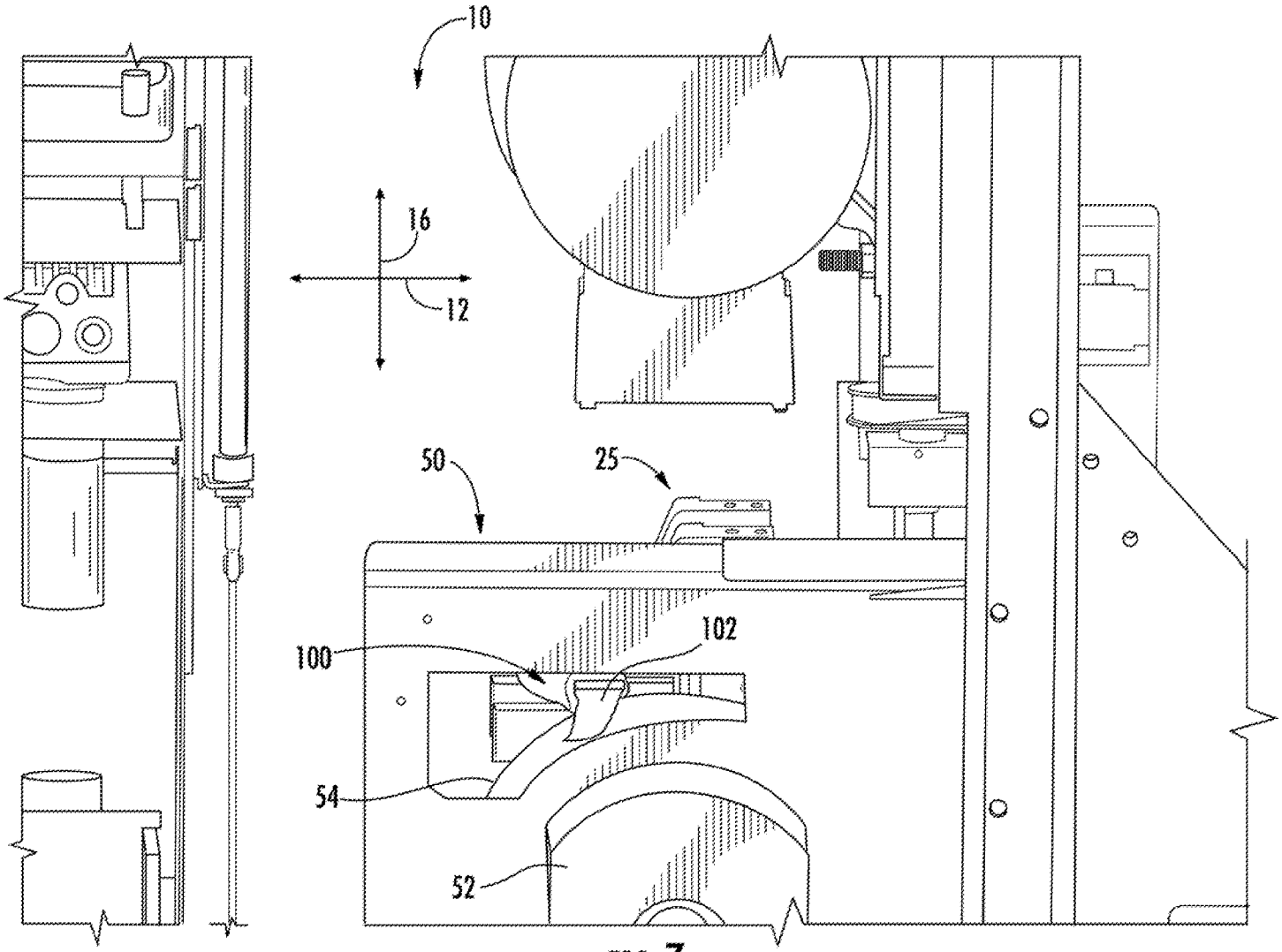
FIG. 7 is a side view of a gripper assembly providing a cutting device for grinding by a grinding assembly in accordance with one embodiment of the present disclosure.
Figure 8:
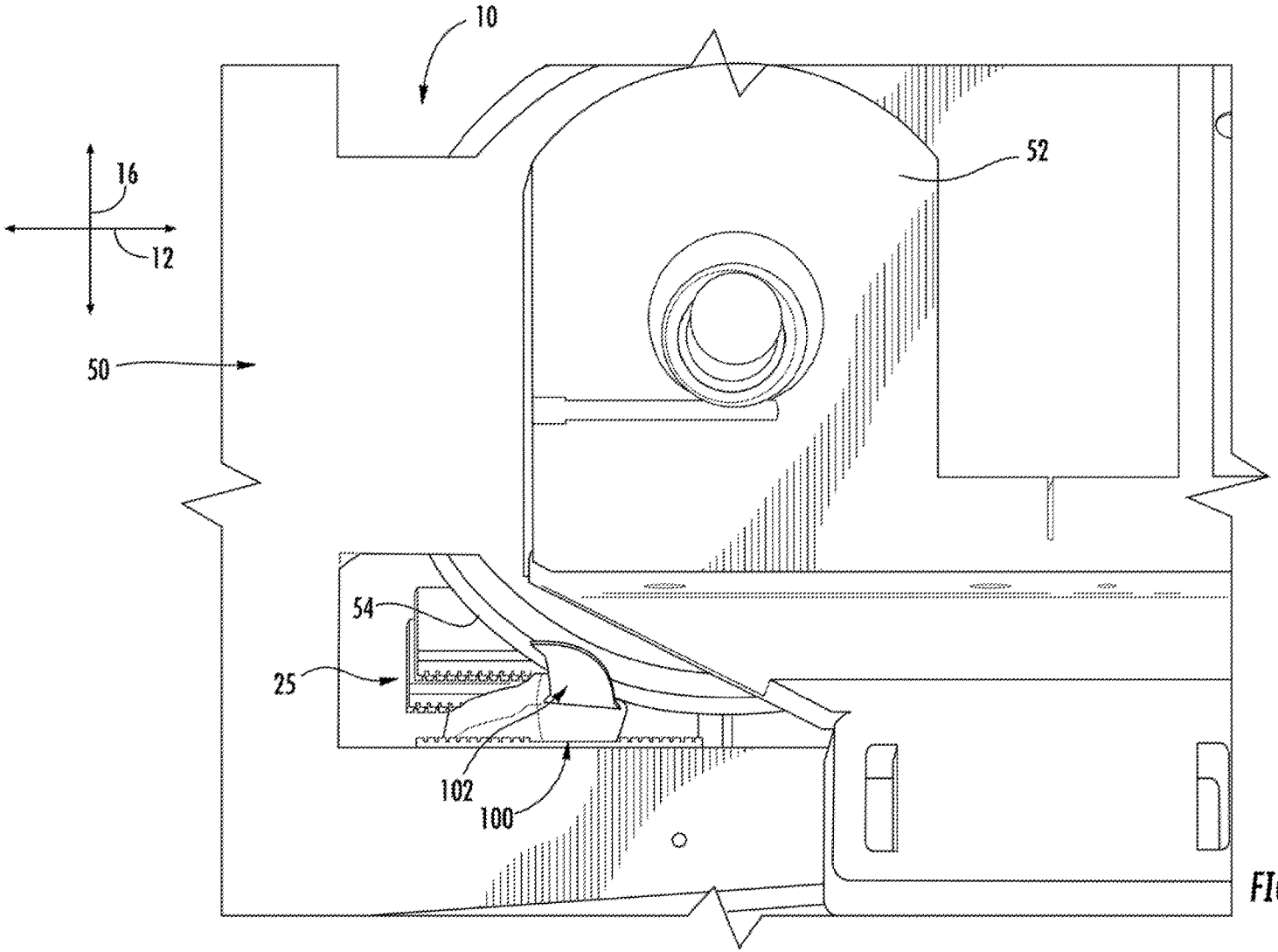
FIG. 8 is another side view of a gripper assembly providing a cutting device for grinding by a grinding assembly in accordance with one embodiment of the present disclosure.

Referring now to FIGS. 6 through 8, system 10 may further include a grinding assembly 50. Grinding assembly 50 may include one or more wheels 52 or other movable devices on which an abrasive grinding media 54 may be provided. The grinding media 54 be moved, such as rotated, and blade 102 may be brought into contact with grinding media 54 to remove material from the blade 102. In the embodiment illustrated, the grinding media 54 forms a belt which is provided on one or more wheels 52 (only one of which is shown) and driven thereby. Grinding assembly 50 may generally be utilized for grinding of the blade 102. In particular, the blade 102 may be moved into contact with grinding media 54, and moved in a pattern while in contact with grinding media 54, such that the cutting edge 106 is ground to match the modified edge profile. Gripper assembly 25 may generally move the blade 102, based on the modified edge profile to contact the grinding media 54 in such manner. Notably, in exemplary embodiments, the entire cutting edge 106 is conditioned by the grinding assembly 50. In other words, the grinding assembly may contact the entire cutting edge 106 during grinding of the blade 102.

To facilitate grinding, the blade 102 may be moved along the X-axis 12 and Y-axis 14 and rotated in the yaw direction 17, and may further be moved along the Z-axis 16, rotated in the roll direction 13 and/or rotated in the pitch direction 15, based on the modified edge profile and data points thereof. The movements may advantageously facilitate grinding of the cutting edge 106 to the modified edge profile. Gripper assembly 25 may, for example, move the blade 102 according to the modified edge profile.

Additionally, blade 102 may be moved into contact with the grinding assembly 50 to thin the blade 102 if required, as discussed herein. Such thinning may, in exemplary embodiments, occur before grinding based on the modified edge profile. Movement of the blade 102 for thinning purposes may be based on a difference between the measured thickness of the blade 102 and the predetermined maximum thickness, as discussed above, such that the blade 102 is ground to at or below the predetermined maximum thickness. Gripper assembly 25 may, for example, move the blade 102 according to the required thickness reduction requirement.

Notably, as illustrated in FIGS. 6 through 8, opposing sides of the blade 102 may be brought into contact with the grinding assembly 50 during grinding to thin the blade 102 and/or during grinding according to the modified edge profile. FIGS. 6 and 7 illustrate grinding on one side of the blade 102, and FIG. 8 illustrates grinding on the opposing side of the blade 102. When grinding to thin the blade, the thickness of the blade may be reduced through grinding on both sides of the blade 102, with approximately equal thickness removal from each side occurring. When grinding according to the modified edge profile, the modified edge profile may be utilized for grinding on both sides, and in exemplary embodiments the entire cutting edge 106 may be conditioned during grinding on both sides.

In some embodiments, after grinding of the blade 102 to the modified edge profile, the blade 102 may be returned to the first measuring device 30 and/or second measuring device 40. The device(s) 30, 40 may measure the blade 102 as discussed above to inspect the blade 102. For example, an inspection edge profile created by such subsequent measurements and resulting data points may be compared to the modified edge profile. Additionally or alternatively, any remaining defects and/or thickness issues may be identified. If such issues remain, a subsequent modified edge profile may be created and the cutting device 100 again provided for grinding, as discussed above.

Figure 9:
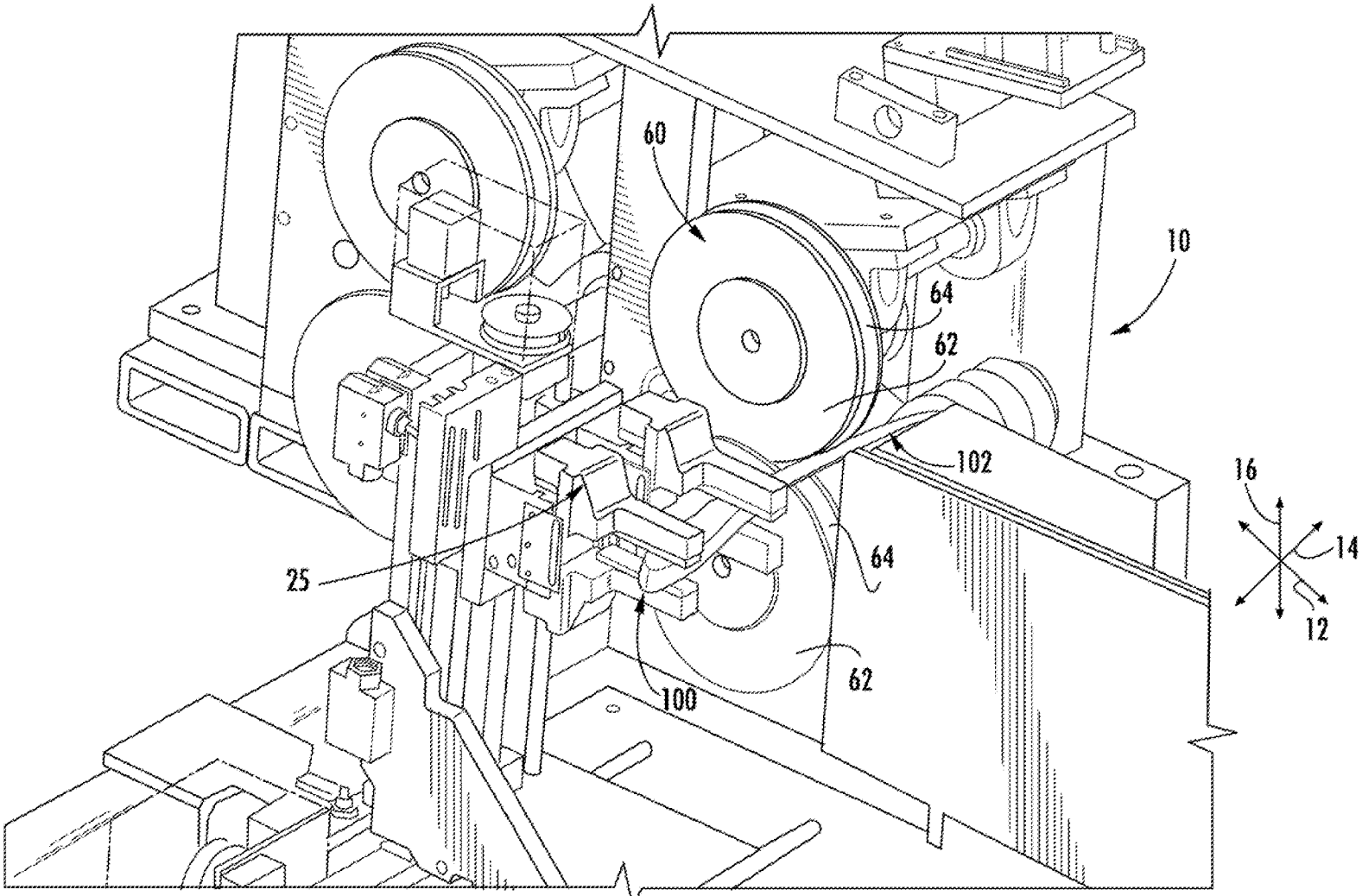
FIG. 9 is a perspective view of a gripper assembly providing a cutting device for buffing by a buffing assembly in accordance with one embodiment of the present disclosure.

Referring now to FIG. 9, system 10 may further include a buffing assembly 60. The buffing assembly 60 may be configured for buffing the blade 102, such as the cutting edge 102 thereof, to for example deburr the cutting edge 102. Buffing assembly 60 may include, for example, one or more wheels 62 or other movable devices on which abrasive buffing media 64 are provided. Notably, abrasive buffing media 64 may be finer than abrasive grinding media 54. In exemplary embodiments, two wheels 62, on each of which is provided an abrasive buffing media 64, are provided. The cutting edge 102 may be moved to between the wheels 62, such that abrasive buffing media 64 contacts both sides of the blade 100 and the cutting edge 102. Movement of the abrasive buffing media 64 (such as rotation on the wheels 62) may buff the cutting edge 102 to remove burrs therefrom. In exemplary embodiments, the entire cutting edge 102 may be buffed. Gripper assembly 25 may, for example, move the blade 102 into contact with the buffing assembly 60 as required, and may do so based for example on the modified edge profile or the inspection edge profile.

Figure 10:
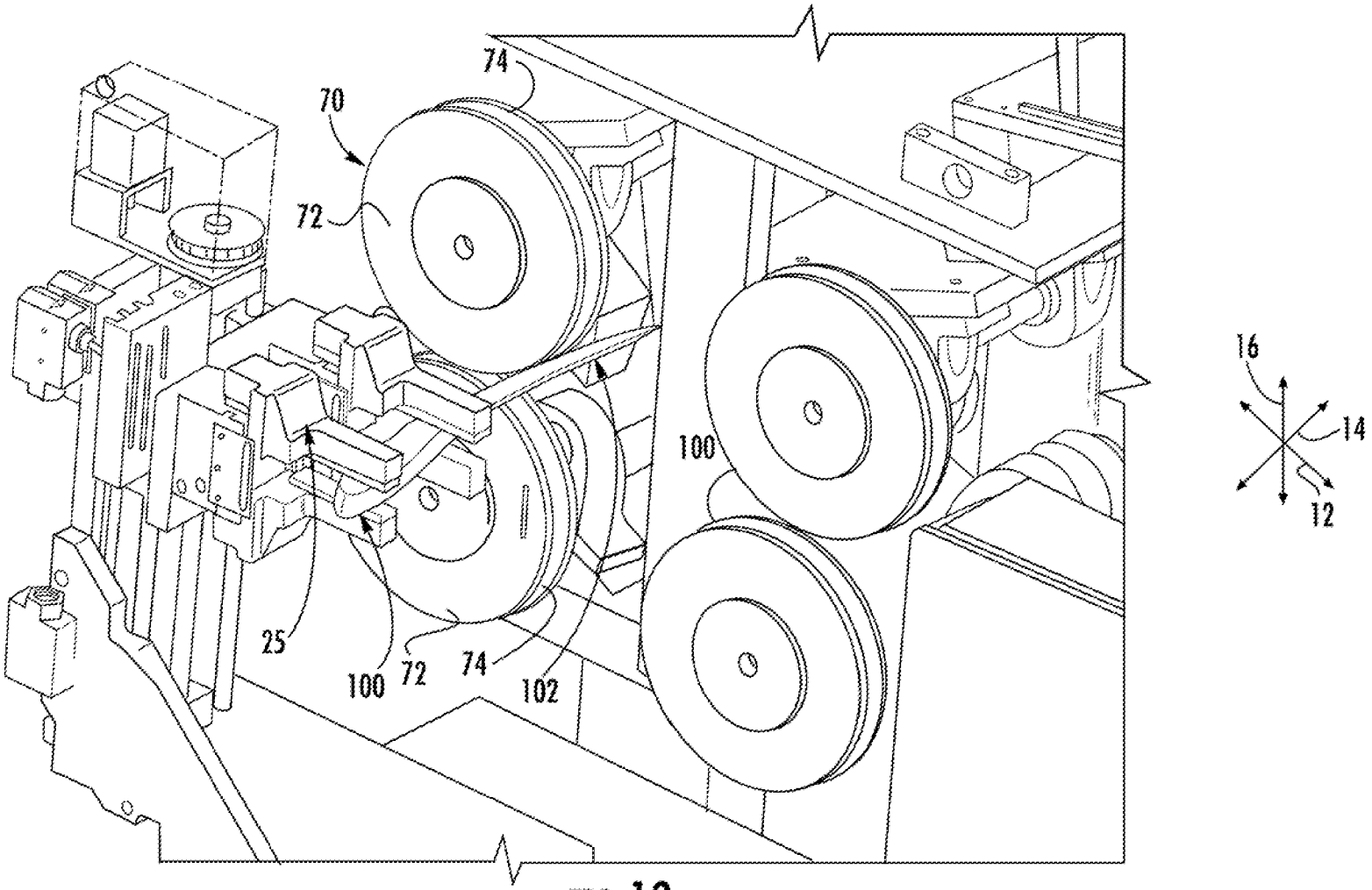
FIG. 10 is a perspective view of a gripper assembly providing a cutting device for polishing by a polishing assembly in accordance with one embodiment of the present disclosure.

Referring now to FIG. 10, system 10 may further include a polishing assembly 70. The polishing assembly 70 may be configured for polishing the blade 102, such as the cutting edge 102 thereof. Such polishing may, for example, occur after buffing. Polishing assembly 70 may include, for example, one or more wheels 72 or other movable devices on which abrasive polishing media 74 are provided. Notably, abrasive polishing media 74 may be finer than abrasive buffing media 64. In exemplary embodiments, two wheels 72, on each of which is provided an abrasive polishing media 74, are provided. The cutting edge 102 may be moved to between the wheels 72, such that abrasive polishing media 74 contacts both sides of the blade 100 and the cutting edge 102. Movement of the abrasive polishing media 74 (such as rotation on the wheels 72) may polish the cutting edge 102. In exemplary embodiments, the entire cutting edge 102 may be polished. Gripper assembly 25 may, for example, move the blade 102 into contact with the polishing assembly 70 as required, and may do so based for example on the modified edge profile or the inspection edge profile.

Notably, processor 20 may be in communication with gripper assembly 25, first measuring device 30, second measuring device 40, grinding assembly 50, buffing assembly 60 and/or polishing assembly 70. For example, processor 20 may activate and deactivate the measuring device 30, second measuring device 40, grinding assembly 50, buffing assembly 60 and/or polishing assembly 70 as required. Further, the processor 20 may activate the gripper assembly 25 to move as discussed herein, to facilitate movement of cutting devices 100 for conditioning purposes as discussed herein.

System 10 may further include various features for monitoring performance of the system 10 during operation thereof. For example, sensors, such as ultrasonic sensors, temperature sensors, and/or voltage sensors, may be provided on various components such as bearings, power supplies, etc. of the system 10. Data from these sensors may be provided to the processor 20, such as at predetermined intervals. Position data for the gripper assembly 25 may additionally be provided to the processor 20, such as at predetermined intervals. Such data may advantageously allow operators of the system 10 to monitor the system, remotely and/or on-site, and address any issues with the system 10 in an efficient manner.

It should further be understood that the various processes that may occur as described herein may, for example, be performed automatically. Accordingly, user inputs between the various steps (and other than to calibrate the system 10 and/or begin the process) may not be required.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for conditioning blades, the system defining an orthogonal coordinate system comprising an X-axis, a Y-axis and a Z-axis, the system comprising:
   - a gripper assembly for gripping a cutting device comprising a blade, the gripper assembly movable along and about the X-axis, the Y-axis and the Z-axis;
   - a first measuring device operable to measure a width and a thickness of the blade, wherein the gripper assembly orients the blade for measurement by the first measuring device;
   - a second measuring device operable to measure the width and a length of the blade, wherein the gripper assembly orients the blade for measurement by the second measuring device, and wherein the second measuring device comprises an imaging device and a light source; and
   - a processor, the processor configured for:
     - creating a current edge profile based on the width, thickness and length measurements; and
     - adjusting the current edge profile to a modified edge profile.

2. The system of claim 1, wherein the first measuring device comprises a first laser and a second laser.

3. The system of claim 1, wherein the current edge profile comprises X-axis, Y-axis and Z-axis data points for the blade.

4. The system of claim 3, wherein adjusting the current edge profile to the modified edge profile comprises deleting X-axis data points which correspond to defects.

5. The system of claim 4, wherein adjusting the current edge profile to the modified edge profile further comprises adding substitute X-axis data points to replace the deleted X-axis data points.

6. The system of claim 1, wherein adjusting the current edge profile to the modified edge profile comprises comparing the thickness to a predetermined maximum thickness.

7. The system of claim 1, wherein the current edge profile and modified edge profile are created for the entire blade.

8. The system of claim 1, further comprising a grinding assembly, wherein the gripper assembly moves the blade for contact with the grinding assembly based on the modified edge profile.

9. The system of claim 1, further comprising a grinding assembly, wherein the gripper assembly moves the blade for contact with the grinding assembly based on the modified edge profile.

10. The system of claim 9, further comprising a buffing assembly, wherein the gripper assembly moves the blade for contact with the buffing assembly after contact with the grinding assembly.

11. The system of claim 10, further comprising a polishing assembly, wherein the gripper assembly moves the blade for contact with the polishing assembly after contact with the buffing assembly.

12. A method for conditioning blades, the method comprising:
   - measuring a width, thickness and length of the blade, wherein measuring the width, thickness and length of the blade comprises:
     - measuring the width and thickness with a first measuring device, wherein the first measuring device comprises a first laser and a second laser; and
     - measuring the width and length with a second measuring device, wherein the second measuring device comprises an imaging device and a light source;
   - creating, using a processor, a current edge profile for the entire blade based on the width, thickness and length measurements, the current edge profile comprising X-axis, Y-axis and Z-axis data points for the blade;
   - adjusting, using a processor, the current edge profile to a modified edge profile; and
   - conditioning the blade based on the modified edge profile.

13. The method of claim 12, wherein adjusting the current edge profile to the modified edge profile comprises deleting X-axis data points which correspond to defects.

14. The method of claim 13, wherein adjusting the current edge profile to the modified edge profile further comprises adding substitute X-axis data points to replace the deleted X-axis data points.

15. The method of claim 12, wherein adjusting the current edge profile to the modified edge profile comprises comparing the thickness to a predetermined maximum thickness.

16. The method of claim 12, wherein conditioning the blade comprises grinding a cutting edge of the blade based on the modified edge profile.

17. The method of claim 16, wherein the entire cutting edge of the blade is ground based on the modified edge profile.

18. The method of claim 12, wherein conditioning the blade comprises thinning a cutting edge of the blade based on the modified edge profile.

* * * * *